US011628338B2

(12) United States Patent
Doi et al.

(10) Patent No.: US 11,628,338 B2
(45) Date of Patent: Apr. 18, 2023

(54) IRON GOLF CLUB HEAD

(71) Applicant: MIZUNO CORPORATION, Osaka (JP)

(72) Inventors: Kazuhiro Doi, Osaka (JP); Kensuke Maenaka, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 17/261,962

(22) PCT Filed: Jan. 22, 2020

(86) PCT No.: PCT/JP2020/002098
§ 371 (c)(1),
(2) Date: Jan. 21, 2021

(87) PCT Pub. No.: WO2020/158535
PCT Pub. Date: Aug. 6, 2020

(65) Prior Publication Data

US 2021/0299524 A1 Sep. 30, 2021

(30) Foreign Application Priority Data

Jan. 29, 2019 (JP) ..... JP2019-012810

(51) Int. Cl.
*A63B 53/04* (2015.01)

(52) U.S. Cl.
CPC ..... *A63B 53/0445* (2020.08); *A63B 53/047* (2013.01); *A63B 2053/0479* (2013.01)

(58) Field of Classification Search
CPC ..... A63B 53/0445; A63B 53/0416; A63B 53/0425; A63B 43/0445
(Continued)

(56) References Cited

U.S. PATENT DOCUMENTS 4,754,970 A * 7/1988 Kobayashi ..... A63B 53/04 473/290
4,754,971 A * 7/1988 Kobayashi ..... A63B 53/047 473/290
(Continued)

FOREIGN PATENT DOCUMENTS

JP H08777 A 1/1996
JP 2013169413 A 9/2013
(Continued)

OTHER PUBLICATIONS

International Search Report dated Apr. 7, 2020 issued in Japanese International Application No. PCT/JP2020/002098.
(Continued)

*Primary Examiner* — Alvin A Hunter
(74) *Attorney, Agent, or Firm* — Troutman Pepper Hamilton Sanders, LLP; James E. Schutz; Korbin M. Blunck

(57) ABSTRACT

An object is to provide an iron golf club head that has high drainage performance and facilitates application of backspin also in a wet state. In an iron golf club head including a plurality of scorelines in a face surface, a microgroove including at least an inclined groove is included between the scorelines, the microgroove extending in a heel leading edge-toe top edge direction to be connected to an upper scoreline.

12 Claims, 3 Drawing Sheets

(58) Field of Classification Search
USPC ..... 473/287, 290, 330, 331
See application file for complete search history.

(56) References Cited

U.S. PATENT DOCUMENTS

| | | | | | |
|---|---|---|---|---|---|
| 5,437,088 | A * | 8/1995 | Igarashi | A63B 60/00 | 473/331 |
| 5,688,186 | A * | 11/1997 | Michaels | A63B 53/047 | 473/331 |
| 6,981,923 | B2 * | 1/2006 | Chappell | A63B 60/00 | 473/331 |
| 7,014,568 | B2 * | 3/2006 | Pelz | A63B 53/047 | 473/331 |
| 7,594,863 | B2 * | 9/2009 | Ban | A63B 53/047 | 473/331 |
| 7,662,049 | B2 * | 2/2010 | Park | B23P 17/00 | 473/331 |
| 7,674,188 | B2 * | 3/2010 | Ban | A63B 53/047 | 473/331 |
| 7,677,990 | B2 * | 3/2010 | Ban | A63B 53/047 | 473/331 |
| 7,695,377 | B2 * | 4/2010 | Yamagishi | A63B 53/047 | 473/331 |
| 7,758,449 | B2 * | 7/2010 | Gilbert | A63B 53/047 | 473/331 |
| 7,780,549 | B2 * | 8/2010 | Park | A63B 53/047 | 473/331 |
| 7,815,521 | B2 * | 10/2010 | Ban | A63B 60/00 | 473/330 |
| 7,819,756 | B2 * | 10/2010 | Ban | A63B 53/047 | 473/330 |
| 7,878,923 | B2 * | 2/2011 | Yamagishi | A63B 53/047 | 473/330 |
| 7,901,297 | B2 * | 3/2011 | Ban | A63B 53/047 | 473/331 |
| 7,918,747 | B2 * | 4/2011 | Johnson | A63B 60/00 | 473/331 |
| 7,976,404 | B2 * | 7/2011 | Golden | A63B 60/00 | 473/331 |
| 8,012,036 | B2 * | 9/2011 | Nakamura | A63B 60/00 | 473/331 |
| 8,118,688 | B2 * | 2/2012 | Nakamura | B21K 23/00 | 473/331 |
| 8,147,352 | B2 * | 4/2012 | Lee | A63B 53/047 | 473/331 |
| 8,172,699 | B2 * | 5/2012 | Nakamura | A63B 53/047 | 473/330 |
| 8,376,877 | B1 * | 2/2013 | Galloway | A63B 53/047 | 473/330 |
| 8,579,723 | B2 * | 11/2013 | Nakamura | A63B 53/047 | 473/331 |
| 8,684,861 | B2 * | 4/2014 | Carlyle | A63B 53/047 | 473/331 |
| 8,758,162 | B2 * | 6/2014 | Ban | A63B 53/047 | 473/331 |
| 8,827,832 | B2 * | 9/2014 | Breier | A63B 53/047 | 473/331 |
| 8,827,833 | B2 * | 9/2014 | Amano | A63B 53/047 | 473/331 |
| 8,858,361 | B2 * | 10/2014 | Ripp | B23C 3/13 | 473/331 |
| 8,979,670 | B2 * | 3/2015 | Aguayo | B23K 26/60 | 473/331 |
| 9,028,340 | B2 * | 5/2015 | Ban | A63B 53/047 | 473/331 |
| 9,033,820 | B2 * | 5/2015 | Kato | A63B 53/047 | 473/331 |
| 9,149,692 | B2 * | 10/2015 | Shimahara | A63B 53/04 | |
| 9,539,477 | B2 * | 1/2017 | Ripp | A63B 53/047 | |
| 9,636,757 | B1 * | 5/2017 | Rice | B23C 5/14 | |
| 9,844,709 | B2 * | 12/2017 | Tassistro | A63B 53/047 | |
| 10,232,231 | B2 * | 3/2019 | Jertson | A63B 53/0466 | |
| 10,279,226 | B2 * | 5/2019 | Ban | A63B 53/047 | |
| 10,343,034 | B2 * | 7/2019 | Henrikson | B23P 15/00 | |
| 10,661,129 | B2 * | 5/2020 | Seagram | A63B 60/00 | |
| 10,835,787 | B1 * | 11/2020 | Evans | A63B 53/0466 | |
| 2006/0025233 | A1 | 2/2006 | Lin | | |
| 2013/0217513 | A1 | 8/2013 | Amano et al. | | |
| 2013/0288820 | A1 | 10/2013 | Shimahara | | |
| 2017/0072274 | A1 | 3/2017 | Jertson et al. | | |

FOREIGN PATENT DOCUMENTS

| | | | |
|---|---|---|---|
| JP | 2013215445 | A | 10/2013 |
| JP | 2013230280 | A | 11/2013 |
| JP | 2014030566 | A | 2/2014 |
| JP | 2017035191 | A | 2/2017 |
| JP | 2017077274 | A | 4/2017 |
| KR | 20130122571 | A | 11/2013 |

OTHER PUBLICATIONS

European Search Report dated Jan. 25, 2022 Issued in European Patent Application No. 20747706.8.

Korean Notification of Reason for Refusal dated Jun. 20, 2022 issued in Korean Patent Application No. 10-2021-7002403.

* cited by examiner

IRON GOLF CLUB HEAD

CROSS-REFERENCE TO RELATED APPLICATION

This application is a U.S. National Stage of International Patent Application No. PCT/JP2020/002098, filed 22 Jan. 2020, which claims the benefit of priority to Japanese Application No. 2019-012810, filed 29 Jan. 2019, the entire contents of which are hereby incorporated in their entireties by reference herein.

TECHNICAL FIELD

The present invention relates to iron golf club heads.

BACKGROUND ART

For an iron golf club such as a wedge, it is required that a consistent backspin be applied irrespective of climate including weather, temperature, and/or humidity. In order to reduce a decrease in the amount of backspin with a wet face surface in a situation such as a rainy day, for example, Japanese Patent Laying-Open No. 2013-215445 (PTL 1) discloses an iron-type golf club head including, between scorelines provided in the face, grooves thinner than the scorelines.

CITATION LIST

Patent Literature

PTL 1: Japanese Patent Laying-Open No. 2013-215445

SUMMARY OF INVENTION

Technical Problem

In order to further improve spin performance in the wet state, however, it is desirable to discharge a water drop on the face more effectively.

The present invention has been made to solve the above problem and has an object to provide an iron golf club head that has high drainage performance and facilitates application of backspin also in the wet state.

Solution to Problem

To solve the above problem, according to the present invention, an iron golf club head with a plurality of scorelines in a face surface includes, between two adjacent scorelines of the plurality of scorelines, a microgroove including at least an inclined groove extending in a heel leading edge-toe top edge direction to be connected to an upper scoreline of the two adjacent scorelines.

Thus, when a ball is hit in a wet state, a water drop squeezed between the face and the ball can be discharged efficiently to the scorelines, leading to improved spin performance in the wet state.

Advantageous Effects of Invention

The present invention can provide an iron golf club head that facilitates application of backspin also in the wet state.

DESCRIPTION OF EMBODIMENTS

Embodiment 1

Figure 1:
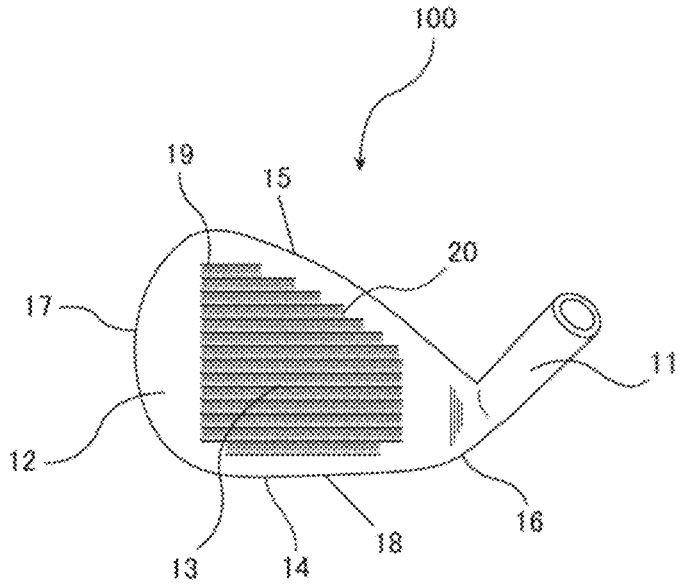
FIG. 1 is a front view of an iron golf club head according to Embodiment 1.

FIG. 1 is a front view of an iron golf club head (hereinafter referred to as "head" as appropriate) 100 according to the present invention.

Referring to FIG. 1, head 100 includes a neck portion 11, which is connected with a shaft, and a main body 12, which is a ball hitting portion. Main body 12 includes a face 13, which is a ball hitting surface, a sole 14, which is a bottom of head 100, a top edge 15, which is an upper edge portion of head 100, a heel 16, which connects a lower end of neck portion 11 and sole 14, a toe 17, which connects sole 14 and top edge 15 at a position at which toe 17 faces heel 16, and a leading edge 18, which defines a boundary between face 13 and sole 14. Head 100 may be of any type as long as it is an iron-type golf club head, and particularly, is preferably a wedge-type iron golf club head that is required to facilitate application of backspin.

Face 13 is provided with a plurality of scorelines 19. Scorelines 19 are provided at a vertical interval of about 3.5 mm in a toe-heel direction. Scoreline 19 has a width of, for example, not less than 0.76 mm and not more than 0.88 mm and a depth of, for example, not less than 0.30 mm and not more than 0.5 mm. Scorelines 19 can be formed by forging, casting, engraving, or the like.

A microgroove 20 narrower than scoreline 19 is provided between scorelines 19. In the present invention, microgrooves 20 mainly function as a drainage path for discharging a water drop adhering to face 13 to scorelines 19 when a ball is hit.

Figure 2:
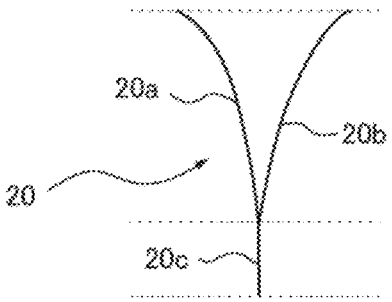
FIG. 2 shows a microgroove according to Embodiment 1.

FIG. 2 shows one microgroove 20 in Embodiment 1. Microgroove 20 includes at least an inclined groove 20 extending in a direction from a lower right to an upper left of face 13 as seen from the front, that is, a heel leading edge-toe top edge direction (hereinafter referred to as "HL-TT direction") while inclining to be connected to an upper scoreline 19.

Inclined groove 20*a* is provided in microgroove 20 for the following reason.

Inventors of the present invention used a high-speed camera to check a motion of a water drop when a ball was hit with the water drop adhering to face 13. Specifically, "T7" available from MIZUNO Corporation was fixed to a golf robot "mechanical golfer" available from Miyamae Co., Ltd. and was set such that a carry of 60 yards was provided. Subsequently, a sprayer was used to spray water onto the ball twice and the surface of face 13 twice to achieve a wet state, and then, the ball was hit with the golf robot. Subsequently, images of the state of the surface of face 13 when the ball was hit were taken with a high-speed camera "Fastcam SA-X2" available from Photron Limited. Images were taken every 0.5 ms up to 3 ms after hitting of the ball.

The inventors checked the taken images to find out that a water drop squeezed between face 13 and the ball flowed toward top edge 15. During golf swing, a centrifugal force in the HL-TT direction is generated on the surface of face 13. Accordingly, minute inclined groove 20*a* extending in the HL-TT direction is provided between scorelines 19, and the upper end of inclined groove 20*a* is connected to scoreline 19, thereby effectively discharging a water drop on face 13 to scoreline 19.

In the present invention, microgrooves, each of which includes at least inclined groove 20*a* extending in the HL-TT direction while inclining to be connected to an upper scoreline 19, are provided between scorelines 19 based on the above finding. In head 100 according to Embodiment 1, an approximately Y-shaped microgroove 20 with inclined groove 20*a* as a left inclination of "Y"-shape is disposed between scorelines 19 for further enhanced drainage performance. Microgroove 20 in Embodiment 1 will now be described in detail.

Referring to FIG. 2, microgroove 20 is composed of inclined groove 20*a* extending in the HL-TT direction, an upper groove 20*b* extending in the direction from the lower left to the upper right of face 13 as seen from the front, that is, the tow leading edge-heel top edge direction (hereinafter referred to as "TL-HT" direction), and a lower groove 20*c* extending substantially perpendicular to scoreline 19. Microgroove 20 can be provided through publicly known laser machining.

Microgroove 20 has a groove width of, for example, 0.020 mm to 0.150 mm and a depth of, for example, 0.0010 mm to 0.0500 mm.

Inclined groove 20*a* and upper groove 20*b* are gently curved in a projecting manner toward top edge 15. This can increase an area which is occupied by microgroove 20 machined in face 13, leading to an enhanced drainage effect. It should be noted that inclined groove 20*a* and upper groove 20*b* may have a linear shape or a shape curved in a projecting manner toward leading edge 18.

Although an angle formed between inclined groove 20*a* and upper groove 20*b* may have any value, from the perspective of increased density at which microgroove 20 is machined, the angle is made to such an extent that inclined groove 20*a* of microgroove 20 preferably intersects upper grooves 20*b* of microgrooves 20 third to fifth on the left from the relevant microgroove 20, as will be described below.

Figure 3:
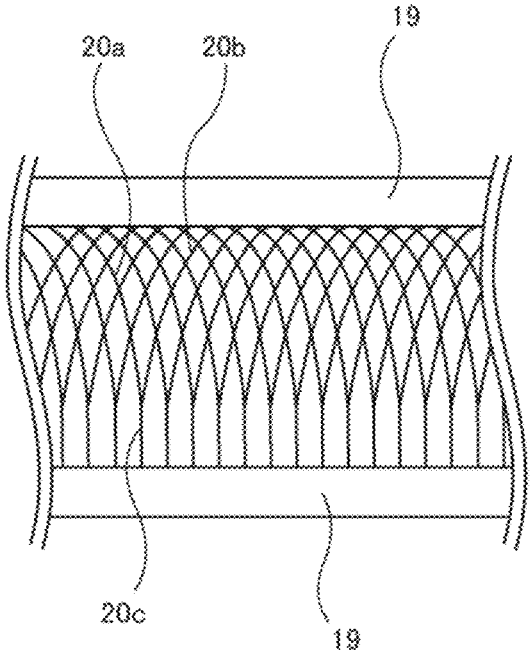
FIG. 3 is a partially enlarged view of a part between scorelines of the iron golf club head according to Embodiment 1.

FIG. 3 is a partially enlarged view of face 13, which shows two scorelines 19 and microgrooves 20 formed therebetween. In Embodiment 1, microgrooves 20 of the same shape are successively disposed such that inclined groove 20*a* of microgroove 20 and upper groove 20*b* of its adjacent microgroove 20 intersect each other.

Inclined groove 20*a* and upper groove 20*b* each have an upper end connected to an upper line 19, and lower groove 20*c* is connected to a lower scoreline 19. The lower end of lower groove 20*c* may not be necessarily connected to lower scoreline 19.

Although microgroove 20 may have any Y shape and may be disposed at any interval between scorelines 19 as long as it includes groove 20*a*, microgroove 20 preferably has a Y shape in which, when a part between scorelines 19 is divided into two equal parts parallel to scorelines 19, an area where microgrooves 20 provided in a region on the top edge 15 side are machined is larger than an area where microgrooves 20 provided in a region on the leading edge 18 side are machined. The reason for this is as follows: since a water drop adhering to face 13 flows toward top edge 15 when a ball is hit, a large number of microgrooves 20 can be machined on the top edge 15 side between two scorelines 15 for enhanced drainage effect, as described above.

From the viewpoint of an enhanced drainage effect, a longer inclined groove 20*a* is more preferable. In contrast, when securing spin performance in the dry state is desired together with drainage performance in the wet state, lower groove 20*c* is desirably secured for a certain length. In other words, an excessively short lower groove 20*c* results in a small area of a smooth region sandwiched between adjacent lower grooves 20*c*. In the dry state, a spin is applied more easily when face 13 and the ball contact in a larger area, and accordingly, the smooth region is preferably present in a large area on face 13.

To attain drainage performance in the wet state and spin performance in the dry state, thus, the lower end of inclined groove 20*a* is preferably set such that, when a length between scorelines 19 is divided into four equal parts, the lower edge is located above lower scoreline 19 by at least a quarter of the length. As a result, microgrooves 20 can be disposed densely in the region on the top edge 15 side with the smooth region left in the region between scorelines 19 in a certain range, attaining spin performance in the wet state and spin performance in the dry state.

From the viewpoint of arithmetic mean roughness Ra of the surface of face 13 (which conforms to JIS B 0601, will be referred to as "surface roughness (Ra)"), the shape and arrangement of microgroove 20 described above can be defied as follows.

When a part between scorelines 19 between which Y-shaped microgrooves 20 are provided is divided into two equal parts, inclined grooves 20*a* and upper grooves 20*c* inclined at a constant angle with respect to scoreline 19 are mainly machined in the region on the top edge 15 side, and lower grooves 20*c* perpendicular to scoreline 19 are mainly machined in the region on the leading edge 18 side. Thus, the surface roughness (Ra) in the toe-heel direction (hereinafter referred to as "TH direction") in the region on the top edge 15 side is greater than the surface roughness (Ra) in the TH direction in the region on the leading edge 18 side.

From the viewpoint of the surface roughness (Ra) in the TH direction, thus, it suffices that microgroove 20 has such a Y shape that includes groove 20*a* connected to upper scoreline 19 and satisfies relation "TH-direction surface roughness (Ra) on the leading edge 18 side <TH-direction surface roughness (Ra) on the top edge 15 side". As long as such a condition (hereinafter referred to as "condition 1") is satisfied, lengths of inclined groove 20*a*, upper groove 20*b*, and lower groove 20*c*, an angle formed between upper groove 20*b* and lower groove 20*c*, the length between inclined groove 20*a* and upper groove 20*b* which is measured on upper scoreline 19, the interval between adjacent microgrooves 20*a*, or the like may have any value.

When microgroove 20 has an approximately Y shape, in comparison between the surface roughness (Ra) in the TH direction and the surface roughness (Ra) in the top edge 15-leading edge 18 direction (hereinafter referred to as "UD direction") between two scorelines 19, the surface roughness (Ra) in the TH direction is greater than the surface roughness (Ra) in the UD direction.

From the viewpoint of the surface roughnesses (Ra) in the TH direction and the UD direction, it suffices that microgroove 20 has such a Y shape that includes inclined groove 20*a* connected to upper scoreline 19 and satisfies relation "UD-direction surface roughness (Ra)<TH-direction surface roughness (Ra)". As long as such a condition (hereinafter referred to as "condition 2") is satisfied, lengths of inclined groove 20*a*, upper groove 20*b*, and lower groove 20*c*, an angle formed between upper groove 20*b* and lower groove 20*c*, the interval between adjacent microgrooves 20*a*, or the like may have any value.

Figure 4:
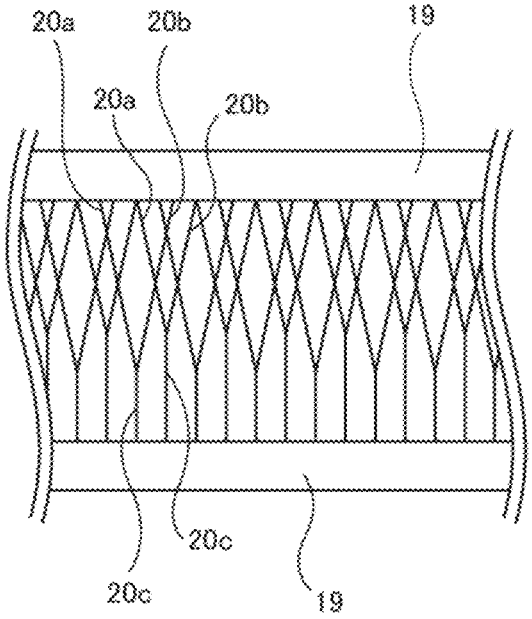
FIG. 4 is a partially enlarged view of a part between scorelines of an iron golf club head according to a modification of Embodiment 1.

Microgrooves 20 disposed between two scorelines 19 may have different Y shapes. FIG. 4 is a partially enlarged view of face 13 in which two types of microgrooves 20 with lower grooves 20*c* of different lengths are disposed alternately. As shown in FIG. 4, also when microgrooves 20 with lower grooves 20*c* of different lengths are disposed, from the viewpoint of drainage performance, microgroove 20 preferably has a Y shape in which, when a part between scorelines 19 is divided into two equal parts in parallel with scorelines 19, an area where microgrooves 20 provided in the region on the top edge 15 side are machined is larger than the area in which microgrooves 20 provided in the region on the leading edge 18 side are machined.

In the case where securing spin performance in the dry state is taken into consideration, when a length between scorelines 19 is divided into four equal parts, the lower end of inclined groove 20*a* with a shorter lower groove 20*c* is preferably set to be located above lower scoreline 19 by at least a quarter of the length. Moreover, from the viewpoint of surface roughness (Ra), it suffices that such a Y shape that satisfies condition 1 or condition 2 is provided.

Microgroove 20 according to the present invention is configured as described above. Iron golf club head 100 according to the present invention can be obtained by forming scorelines 19 in a head main body molded through forging or casting and then providing microgrooves 20 described above between scorelines 19. Head 100 may be subjected to plating such as nickel (Ni)-chrome (Cr) plating, or the surface of face 13 may be subjected to milling. The iron golf club according to the present invention can be obtained by inserting a shaft (not shown) into neck portion 11 of the thus obtained head 100 for fixing and then attaching a grip to the shaft.

As described above, in iron golf club head 100 according to Embodiment 1, microgrooves 20 each including at least inclined groove 20*a* are disposed between two scorelines 19, where inclined groove 20*a* extends in the heel leading edge-toe top edge direction and is connected to upper scoreline 19. Thus, a water drop that is squeezed between face 13 and the ball and flows toward top edge 15 can be discharged effectively to upper scoreline 19. This leads to enhanced spin performance in the wet state.

Figure 5:
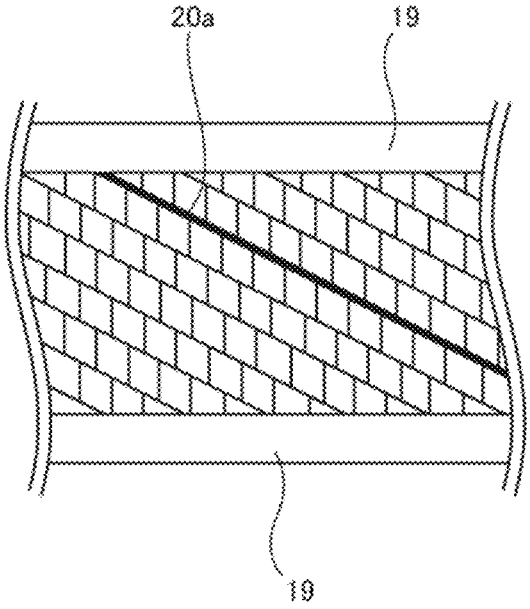
FIG. 5 is a partially enlarged view of a part between scorelines of an iron golf club head according to a modification of Embodiment 1.

Since it suffices that microgroove 20 according to the present invention includes inclined groove 20*a* extending in the HL-TT direction to be connected to upper scoreline 19, the shape of microgroove 20 is not necessarily limited to the Y shape. For example, inclined groove 20*a* extending linearly in the HL-TT direction (for convenience of illustration, one inclined groove 20*a* is indicated by the bold line in FIG. 5) itself may serve as microgroove 20, and such inclined grooves 20*a* may be provided at predetermined intervals, as shown in FIG. 5. In this case, drainage performance can be enhanced by connecting inclined grooves 20*a* with short longitudinal grooves.

Figure 6:
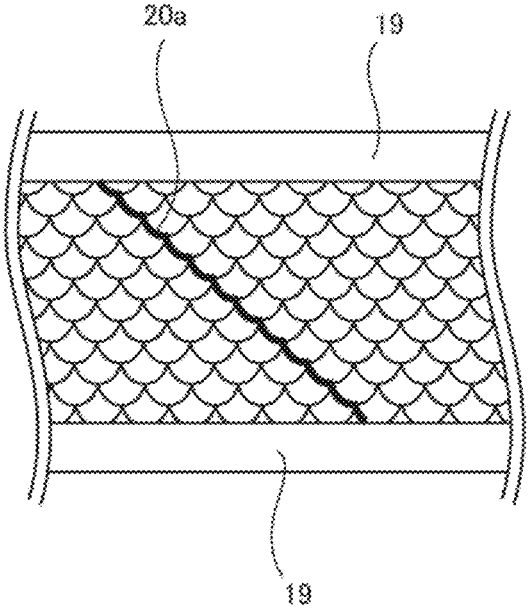
FIG. 6 is a partially enlarged view of a part between scorelines of an iron golf club head according to a modification of Embodiment 1.

Alternatively, as shown in FIG. 6, inclined grooves 20*a* of semi-cylindrical shape which extend in the HL-TT direction (for convenience of illustration, one inclined groove 20*a* is indicated by the bold line in FIG. 6) themselves may serve as microgrooves 20, and such inclined grooves 20*a* may be provided at predetermined intervals. Inclined grooves 20*a* are formed by repetitively arranging, in the TH direction, shallow U-shaped grooves curved in a projecting manner toward leading edge 18 and then arranging such repetitive arrangements in the UD direction while displacing the repetitive arrangements from each other at predetermined intervals. In this case, drainage performance can be enhanced by connecting microgrooves 20 with arc-shaped grooves.

EXAMPLES

As examples of the present invention, heads 100 of Examples 1 to 4 with microgrooves 20 of different shapes were produced, and shafts were attached to heads 100, thereby producing golf clubs according to Examples 1 to 4. In all of heads 100 according to Examples 1 to 4, microgrooves 20 were laser-machined with a laser beam machine in face 13 of "T7" available from MIZUNO Corporation (loft angle: 52°, bounce angle: 9°, lie angle: 63°, number of scorelines: 16, interval between scorelines: 3.5 mm). Microgrooves 20 of Examples 1 to 4 will be described in detail as follows.

In Example 1, Y-shaped microgrooves 20 of the same shape were provided between scorelines 19, as shown in FIG. 3. Inclined grooves 20*a* and upper grooves 20 were shaped to be curved gently and upwardly. Inclined grooves 20*a* and upper grooves 20*b* were connected to upper scoreline 19, and lower grooves 20*c* were connected to lower scoreline 19. In microgroove 20, the length of lower groove 20*c* was 1.1 mm, and the length between inclined groove 20*a* and upper groove 20*b*, measured on upper scoreline 19, was 1.13 mm. Inclined groove 20*a* had a width of 0.103 mm and a depth of 0.0164 mm. Lower grooves 20*c* of adjacent microgrooves 20 were disposed at an interval of 0.3 mm.

In Example 2, two types of Y-shaped microgrooves 20 with lower grooves 20*c* of different lengths were provided between scorelines 19, as shown in FIG. 4. Inclined groove 20*a* and upper groove 20*b* each had a linear shape. In a first microgroove 20 with a longer lower groove 20*c*, the length of lower groove 20*c* was 1.72 mm, and the length between inclined groove 20*a* and upper groove 20*b* measured on upper scoreline 19 was 0.51 mm. In a second microgroove 20 with a shorter lower groove 20*c*, the length of lower groove 20*c* was 1.25 mm, and the length between inclined groove 20*a* and upper groove 20*b* measured on upper scoreline 19 was 0.70 mm. First and second microgrooves 20 were alternately and repetitively provided at an interval of 0.35 mm. Also, in both of first and second microgrooves 20, inclined grooves 20*a* and upper grooves 20*b* were connected to upper scoreline 19, and lower grooves 20*c* were connected to lower scoreline 19.

In Example 3, linear inclined grooves 20*a* extending in the HL-TT direction were provided in the TH direction at an interval of 1.0 mm, as shown in FIG. 5. In Example 3, inclined groove 20*a* itself was microgroove 20. Inclined groove 20*a* was extended at an angle of about 29° with respect to the scoreline. Inclined grooves 20*a* were connected to each other at an interval of 0.4 mm by short longitudinal grooves perpendicular to scorelines 19.

In Example 4, shallow U-shaped grooves were repetitively arranged to provide continuous semicircular inclined grooves 20*a* extending in the HL-TT direction at an interval of 0.6 mm in the TH direction, as shown in FIG. 6. In Example 4, inclined groove 20*a* itself was microgroove 20. The shallow U-shape had a width of 0.6 mm and a height of 0.3 mm.

On the other hand, "T7" available from MIZUNO Corporation was prepared as Comparative Example 1. The specific configuration of the head of Comparative Example 1 was identical to those of Examples 1 to 4 except for that no microgrooves 20 were provided.

An amount of backspin and a carry were measured in each of the wet state and the dry state using Examples 1 to 4 and Comparative Example 1. The amount of backspin was measured with a "mechanical golfer" available from Miyamae Co., Ltd. by measuring the number of rotations of backspin in 60-yard shot with the iron golf clubs according to Examples 1 to 4 and Comparative Example 1. The number of rotations of backspin of a ball was measured with a ball trajectory measuring device "TRACKMAN" available from TrackMan. A ball "MPS" available from MIZUNO Corporation was used. In the measurement in the wet state, a sprayer was used to spray water onto the ball twice and the surface of face 13 twice to reproduce the wet state, and the ball was hit.

Also, for each of Examples 1 to 4 and Comparative Example 1, the surface roughness (Ra) between scorelines 19 was measured in the TH direction and the UD direction. For the TH direction, surface roughness (Ra) was measured for each of a region on the top edge 15 side and a region on the leading edge 18 side when a part between scorelines 19 was divided into two equal parts. For the UD direction, surface roughness (Ra) was measured at the center of a scoreline between the fourth and fifth scorelines.

The measurement of surface roughness (Ra) was evaluated based on JIS B0601-1994 with "SURFTEST SJ-210" available from Mitutoyo Corporation. The measuring conditions were as follows: a measurement length of 12.5 mm, a reference length of 2.5 mm, and a cutoff value of 2.5 mm. Surface roughness (Ra) was measured three times for each measurement condition, and an average thereof was set as a measured value. Table 1 shows the results of the robot test and the measured values of the surface roughness (Ra).

TABLE 1

| | Backspin | | | Carry | | | Surface roughness (Ra) | | |
|---|---|---|---|---|---|---|---|---|---|
| | Dry (rpm) | Wet (rpm) | Rate of change (%) | Dry (yrd) | Wet (yrd) | Rate of change (%) | UD direction | TH-direction top edge side | TH-direction leading edge side |
| Example 1 | 6098 | 6595 | 108 | 58.7 | 58.3 | 99 | 1.09 | 1.62 | 1.27 |
| Example 2 | 6041 | 6511 | 108 | 61.4 | 60.5 | 98 | 1.28 | 1.96 | 1.22 |
| Example 3 | 6159 | 6377 | 104 | 59.2 | 58.0 | 98 | 1.30 | 1.47 | 1.67 |
| Example 4 | 6009 | 6492 | 108 | 59.8 | 59.3 | 99 | 1.79 | 1.93 | 1.70 |
| Comparative Example | 6020 | 5284 | 88 | 60.2 | 60.4 | 100 | 0.70 | 0.44 | 0.45 |

The results of Table 1 reveal that an amount of backspin in the wet state is higher than that in the dry state in all of Examples 1 to 4. The present invention can thus provide an iron golf club that facilitates application of backspin also in the wet state.

REFERENCE SIGNS LIST

11: neck portion, 12: main body, 13: face, 14: sole, 15: top edge, 16: heel, 17: toe, 18: leading edge, 19: scoreline, 20: microgroove, 20*a*: inclined groove, 20*b*: upper groove, 20*c*: lower groove, 100: iron golf club head.

The invention claimed is:

1. An iron golf club head with a plurality of scorelines in a face surface, the iron golf club head comprising a plurality of microgrooves between two adjacent scorelines of the plurality of scorelines, each microgroove of the plurality of microgrooves including at least an inclined groove extending in a heel leading edge-toe top edge direction to be connected to an upper scoreline of the two adjacent scorelines, wherein when a part between the two adjacent scorelines is divided into two equal parts in a top edge-leading edge direction, a surface roughness (Ra) along an entire length between the two adjacent scorelines in a toe-heel direction on a top edge side is greater than a surface roughness (Ra) along the entire length between the two adjacent scorelines in the toe-heel direction on a leading edge side.

2. The iron golf club head according to claim 1, wherein the microgroove has a generally Y shape.

3. The iron golf club head according to claim 2, wherein when a part between the scorelines is divided into two equal parts, an area in which the microgroove provided in a region on the top edge side is machined is larger than an area in which the microgroove provided in a region on the leading edge side is machined.

4. The iron golf club head according to claim 2, wherein when a length between the scorelines is divided into four equal parts, a lower end of the inclined groove is located above a lower scoreline of the two adjacent scorelines by at least a quarter of the length.

5. The iron golf club head according to claim 1, wherein each microgroove of the plurality of microgrooves further comprises an upper groove extending in a toe leading edge-heel top edge direction to be connected to the upper scoreline of the two adjacent scorelines.

6. The iron golf club head according to claim 5, wherein an angle between the inclined groove and the upper groove is such that (1) the inclined groove intersects at least two adjacent upper grooves, and (2) the upper groove intersects at least two adjacent inclined grooves.

7. The iron golf club head according to claim 5, wherein each microgroove of the plurality of microgrooves further comprises a lower groove extending from an intersection of the inclined groove and the upper groove toward a lower scoreline of the two adjacent scorelines.

8. The iron golf club head according to claim 7, wherein a lower most end of the lower groove is positioned a distance from the lower scoreline.

9. An iron golf club head with a plurality of scorelines in a face surface, the iron golf club head comprising a plurality of microgrooves between two adjacent scorelines of the plurality of scorelines, each microgroove of the plurality of microgrooves including at least an inclined groove extending in a heel leading edge-toe top edge direction to be connected to an upper scoreline of the two adjacent scorelines, wherein when a part between the two adjacent scorelines is divided into two equal parts in a top edge-leading edge direction, a surface roughness (Ra) along an entire length between the two adjacent scorelines in a toe-heel direction on a top edge side is greater than a surface roughness (Ra) along the entire length between the two adjacent scorelines in the top edge-leading edge direction.

10. The iron golf club head according to claim 9, wherein the microgroove has a generally Y shape.

11. The iron golf club head according to claim 10, wherein when a part between the scorelines is divided into two equal parts, an area in which the microgroove provided in a region on the top edge side is machined is larger than an area in which the microgroove provided in a region on the leading edge side is machined.

12. The iron golf club head according to claim 10, wherein when a length between the scorelines is divided into four equal parts, a lower end of the inclined groove is located above a lower scoreline of the two adjacent scorelines by at least a quarter of the length.

* * * * *